US006503222B2

(12) United States Patent
Lo

(10) Patent No.: US 6,503,222 B2
(45) Date of Patent: Jan. 7, 2003

(54) ORAL DOSAGE DISPENSER

(75) Inventor: Julian B. Lo, Old Lyme, CT (US)

(73) Assignee: Pfizer Inc, New York, NY (US)

( * ) Notice: Subject to any disclaimer, the term of this patent is extended or adjusted under 35 U.S.C. 154(b) by 0 days.

(21) Appl. No.: 09/960,001

(22) Filed: Sep. 21, 2001

(65) Prior Publication Data

US 2002/0036217 A1 Mar. 28, 2002

Related U.S. Application Data

(60) Provisional application No. 60/236,224, filed on Sep. 28, 2000.

(51) Int. Cl.[7] ..... A61J 7/00

(52) U.S. Cl. ..... 604/77; 215/389; 215/DIG. 3; 215/DIG. 7; 215/DIG. 8; 220/710; 222/145.2; 222/205; 239/33

(58) Field of Search ..... 222/145.5, 180, 222/630, 205, 464.1, 424.5; 239/24, 33, 310; 220/703, 705, 710; 229/103.1; 215/387, 388, 389, DIG. 3, DIG. 8, DIG. 7; 604/93.01, 264, 77, 80–85

(56) References Cited

U.S. PATENT DOCUMENTS

| | | | | |
|---|---|---|---|---|
| 2,436,505 A | | 2/1948 | Du Rall | 128/222 |
| 2,689,149 A | * | 9/1954 | Saltzman | 239/33 |
| 3,610,483 A | | 10/1971 | Visconti | 222/478 |
| 4,211,024 A | * | 7/1980 | Nickell | 40/406 |
| 5,085,335 A | * | 2/1992 | Carbaugh | 220/709 |
| 5,222,940 A | * | 6/1993 | Wilk | 604/77 |
| 6,109,538 A | * | 8/2000 | Villani et al. | 239/33 |

* cited by examiner

*Primary Examiner*—Henry C. Yuen
*Assistant Examiner*—Patrick Buechner
(74) *Attorney, Agent, or Firm*—Peter C. Richardson; Gregg C. Benson; Carl J. Goddard

(57) ABSTRACT

The present invention provides an apparatus for facilitating the oral delivery of an active agent to a patient in need of treatment therewith, which apparatus comprises an active agent mixing chamber, a mixture delivery tube, and at least one liquid delivery tube. A mixture formed in the mixing chamber which comprises a combination of an active agent, or a pharmaceutical formulation thereof, and a liquid diluent may be delivered into the oral cavity of the patient from the mixing chamber by suction on the mixture delivery tube.

5 Claims, 2 Drawing Sheets

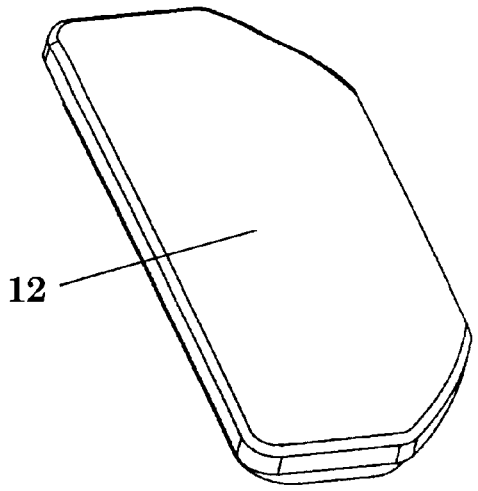
*Fig. 1*
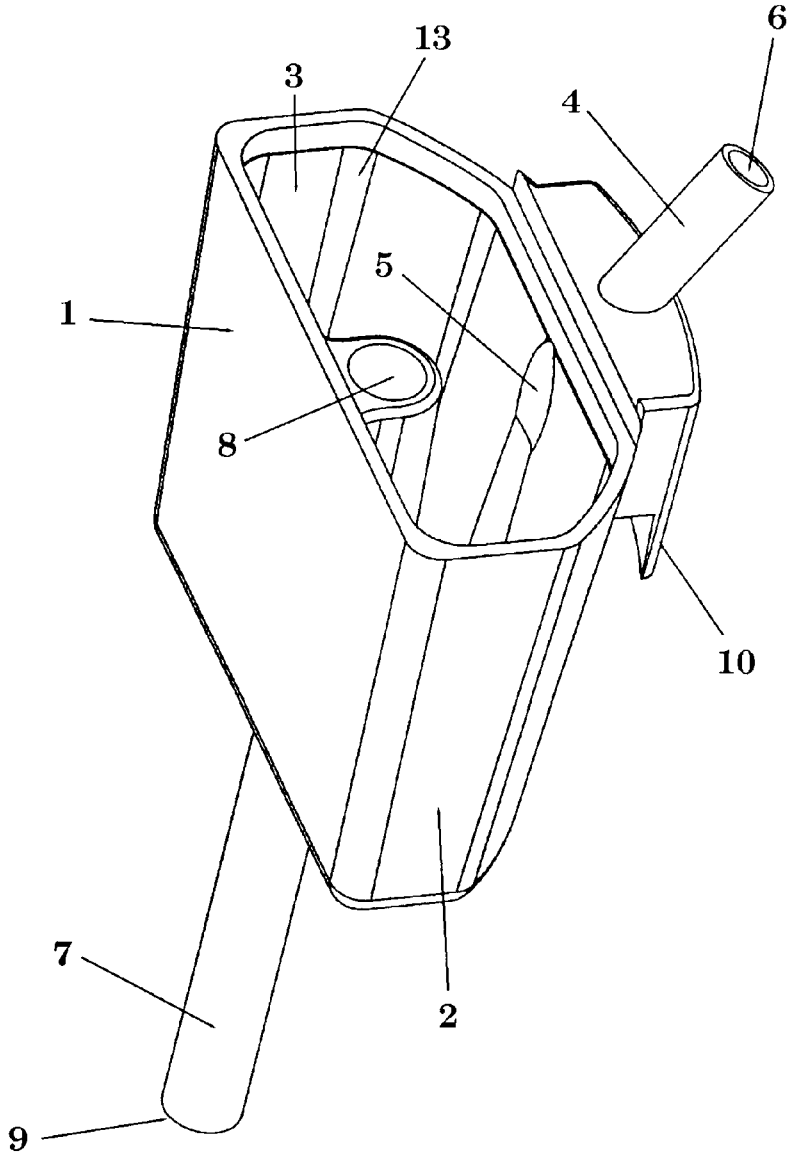

ORAL DOSAGE DISPENSER

CROSS REFERENCE TO RELATED APPLICATION

This application claims the benefit of U.S. Provisional Application No. 60/236,224 filed Sep. 28, 2000.

FIELD OF THE INVENTION

The present invention relates to the oral delivery of active agents. More particularly, the invention provides an apparatus for facilitating the oral delivery of an active agent to a patient in need of treatment therewith, which apparatus comprises an active agent mixing chamber, a mixture delivery tube, and at least one liquid delivery tube. The active agent mixing chamber is charged with the active agent, or a pharmaceutical formulation thereof, the apparatus is sealed, and a liquid diluent is drawn into the active agent mixing chamber by a vacuum created therein by suction imparted through the mixture delivery tube, thereby mixing the active agent with the liquid diluent. The active agent/liquid diluent mixture thus formed may then be drawn into the oral cavity of the user from the active agent mixing chamber by continued suction on the mixture delivery tube.

BACKGROUND OF THE INVENTION

Because of age or physical infirmity, many patients encounter considerable difficulty in swallowing solid oral dosage forms. For example, Kikendall et al., *Digestive Diseases and Sciences,* 28:2 (1983), report that there were 221 cases documented between 1970 and 1982 of tablet and capsule induced esophageal injury. The most commonly implicated drug formulations were tetracycline (108 cases), emepromium bromide (36 cases), potassium chloride (16 cases), and ferrous salts (12 cases).

Accordingly, there exists a need for oral dosage forms where the swallowing of a large, solid system is avoided and which forms are facile of use and manufacture. In response thereto, so-called "Dose-Sipping Technology" has been developed. For example, U.S. Pat. No. 2,436,505 discloses a pill douser for administering medicaments in liquid form or in pills or tablets. The device has a bowl at the top for containing the medicament and a tube that can be submerged in a liquid held in a drinking glass. The liquid is drawn upward for administering the liquid together with any pill or tablet present in the bowl. U.S. Pat. No. 2,867,536 discloses an improved drinking straw where a soluble flavoring material is contained within an annular space contained within an inner and outer tube. The inner tube has a bore through which liquid can be drawn. During use, the upper and lower caps are removed, the flavoring material is emptied into the liquid and the flavored liquid is drawn up through the inner tube and into the mouth. U.S. Pat. No. 3,610,483 discloses a dispensing device for liquid medication that is formed in the shape of a straw. A predetermined dose of liquid medication is loaded into the straw which is then capped at both ends until the medication is dispensed, at which point the user removes the caps and sucks air into the device.

Many of the aforementioned devices suffer from certain disadvantages inherent to such delivery systems, including, for example, incomplete and/or non-uniform mixing of the active agent with the liquid diluent prior to ingestion of the formed mixture by the patient, clogging or obstruction of the dosage dispensing tube with undissolved active agent during ingestion of the formed mixture, and the like. Furthermore, certain prior art devices, especially those dispensers comprising drinking straw arrangements, suffer from the additional disadvantage of containing and permitting the ingestion of only relatively small amounts of an active agent mixture, i.e. that amount which can be safely and conveniently generated in an apparatus with a tube or bore having the circumference of a drinking straw.

The instant invention obviates the aforementioned disadvantages by providing an apparatus comprising an active agent mixing chamber, a hollow mixture delivery tube, and at least one hollow liquid delivery tube which is capable of containing relatively large amounts of active agent for mixing with a liquid diluent. Because of the relative placement of the mixture delivery tube and the liquid delivery tube inside the active agent mixing chamber, the active agent contained therein may be mixed completely and uniformly with the liquid diluent without presenting the potential of clogging or obstruction during delivery of the active agent solution or suspension to the user of the apparatus.

SUMMARY OF THE INVENTION

The present invention provides an apparatus for facilitating the oral delivery of an active agent to a patient in need of treatment therewith, which apparatus comprises an active agent mixing chamber, a mixture delivery tube, and at least one liquid delivery tube. A mixture formed in the mixing chamber which comprises a combination of an active agent, or a pharmaceutical formulation thereof, and a liquid diluent may be delivered into the oral cavity of the patient from the mixing chamber by suction on the mixture delivery tube.

BRIEF DESCRIPTION OF THE DRAWINGS

For a more complete understanding of the invention, reference is now directed towards the embodiments illustrated in greater detail in the accompanying drawings and described hereinbelow by way of examples of the invention.

In the drawings:

FIG. 1 depicts an overhead, fragmentary perspective view of an embodiment of the apparatus of the instant invention.

REFERENCE NUMERALS IN THE DRAWINGS

Figure 2:
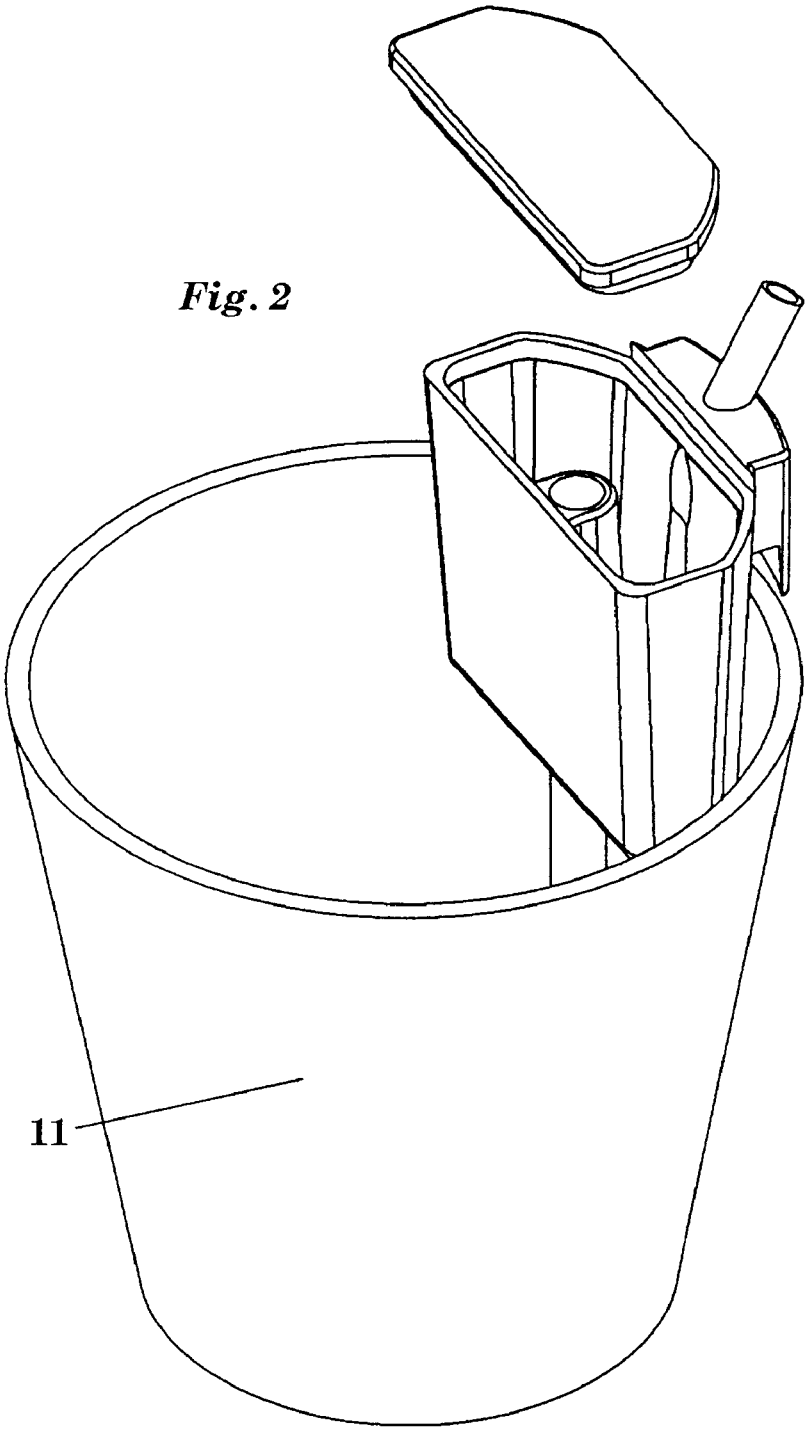
FIG. 2 illustrates a side, fragmentary perspective view of an embodiment of the apparatus of the invention wherein the apparatus is immersed in a liquid reservoir.

1 active agent mixing chamber
2 outer wall
3 inner wall
4 mixture delivery tube
5 mixture delivery tube first open end portion
6 mixture delivery tube second open end portion
7 liquid delivery tube
8 liquid delivery tube first open end portion
9 liquid delivery tube second open end portion
10 mounting means
11 liquid reservoir
12 sealing means
13 surface contour

DETAILED DESCRIPTION OF THE INVENTION

The invention provides an apparatus for the oral delivery of active agents which comprises a sealable active agent mixing chamber, a hollow mixture delivery tube, and at least one hollow liquid delivery tube.

The apparatus comprises a sealable active agent mixing chamber 1 comprising outer 2 and inner 3 walls, wherein the inner wall 3 defines a compartment for containing and mixing an active agent with a liquid diluent to form a solution or suspension which may then be dispensed or delivered into the oral cavity of the user of the apparatus.

The active agent mixing chamber 1 may be formed from any suitable material that is physically and/or chemically compatible with both the active agent and the liquid diluent to be mixed therein. Suitable polymeric materials may comprise, for example, polyvinyl chloride, polystyrene, high density polyethylene, polypropylene, polyethylene terephthalate (PET), polyethylene terephthalate glycol (PETG), or amorphous polyethylene terephthalate (APET), as well as laminates and coextrusions thereof. Other suitable materials may also comprise physiologically and chemically compatible metallic materials, including, for example, stainless steel, aluminum, and the like. The material comprising the active agent mixing chamber 1 should have sufficient rigidity and tensile strength to withstand certain effects resulting from the generation of a partial vacuum created therein by imparting negative pressure thereto during operation of the device. Such effects may include, for example, the partial or complete deformation or collapse of the active agent mixing chamber. If the material comprising the mixing chamber 1 comprises a polymeric material, it is to be understood that such material may be either transparent, in order to provide visual aid in determining the homogeneity of the mixture formed therein, or opaque, in order to prevent attracting the undesired attention of children to the contents contained therein. The inner wall 3 of the mixing chamber 1 preferably incorporates surface contour features 13, preferably comprising flutes, grooves, or similar patterns, in order to facilitate an active, uniform flow of the liquid diluent from the liquid delivery tube down and along the surfaces thereof, such that the mixing action of the liquid diluent and the active agent is promoted.

The active agent mixing chamber 1 is charged with an active agent, or a pharmaceutical formulation thereof, to be admixed with a liquid diluent. Such active agent, or formulation thereof, preferably comprises a pharmaceutical therapeutant, a diagnostic reagent, a drug, a prodrug, a nutritional supplement, or a similar physiologically active material. Any active agent so defined may be employed in the apparatus of the invention, provided that such active agent is chemically compatible with the material or materials comprising the apparatus and the liquid diluent with which the active agent is to be admixed. The active agent, or a formulation thereof, may comprise either a solid, preferably a finely powdered material, or a liquid form.

The active agent, or a formulation thereof, contained in the active agent mixing chamber 1 is admixed with a liquid diluent in the mixing chamber 1 prior to delivery into the oral cavity of the user of the apparatus. The liquid diluent may comprise any conventional pharmaceutically acceptable carrier, vehicle, adjuvant, or diluent known to one of ordinary skill in the art for dissolving or suspending a pharmaceutically active agent. Such carriers, vehicles, adjuvants, or diluents may comprise, for example, water; lower molecular weight alcohols, such as ethanol; polyols, such as propylene glycol, polyethylene glycol, glycerol, and the like; and vegetable oils; as well as various mixtures and/or combinations thereof. Additional liquid diluents will be known, or apparent in view of the instant disclosure, to one of ordinary skill in the art. The resulting mixture of the active agent, or a formulation thereof, and the liquid diluent generally comprises a solution, suspension, or similar dosage form that is suitable for oral delivery to a patient in need of treatment therewith and is of a sufficiently low viscosity and/or high fluidity to permit facile passage from the active agent formulation chamber 1, through the hollow mixture delivery tube 4, and into the oral cavity of the user of the apparatus.

Once the apparatus has been charged with the active agent, or a formulation thereof, the mixing chamber 1 is removably sealed with sealing means 12 to prevent loss and/or spillage of the contents contained therein, and to create an environment conducive to the formation of a vacuum therein upon imparting negative pressure to the active agent mixing chamber 1, preferably through mixture delivery tube 4. The sealing means 12 may comprise any conventional arrangement known to one of ordinary skill in the art for sealing a medicament container including, for example, a screw-threaded or frictionally-engageable cap, lid or similar, or different, means. The material employed to form the sealing means 12 may comprise the same, or different, material or materials as that used to form the active agent mixing chamber 1. The imparting of negative pressure on the active agent mixing chamber 1 is normally that effected through the mixture delivery tube 4 by suction generated by the lips and mouth of the user. Upon imparting of suction thus described, the active agent mixture formed in the active agent mixing chamber 1 is drawn through the hollow mixture delivery tube 4 and into the oral cavity of the user.

The apparatus further comprises a hollow mixture delivery tube 4 comprising first 5 and second 6 open end portions wherein the first open end portion 5 of the mixture delivery tube 4 is inserted into, or formed integrally with, the outer wall 2 of the active agent mixing chamber 1 and through the inner wall 3 of the active agent mixing chamber 1, the first open end portion 5 forming an passage thereinto, such as that depicted in FIG. 1. The second open end portion 6 of the mixture delivery tube 4 permits passage of the active agent solution or suspension formed in the mixing chamber 1 through the hollow mixture delivery tube 4, out through the second open end portion 6 thereof, and into the oral cavity of the user of the apparatus. Preferably, in order to provide a convenient and uniform flow of the active agent solution or suspension through the mixture delivery tube 4, the first open end portion 5 of the mixture delivery tube 4 is inserted into the outer wall 2 of the active agent mixing chamber 1, at an angle tangential thereto. The hollow mixture delivery tube 4 may be formed from any suitable material that is toxicologically compatible with the user of the apparatus, and chemically compatible with the active agent and the liquid diluent with which the active agent is admixed. Such suitable materials may comprise, for example, paper, or a polymeric or metallic material, such as that disclosed hereinabove to form the active agent mixing chamber 1.

The apparatus further comprises at least one hollow liquid delivery tube 7 comprising first 8 and second 9 open end portions wherein the first open end portion 8 of the liquid delivery tube 7 is inserted into, or formed integrally with, the outer wall 2 of the active agent mixing chamber 1 and through the inner wall 3 of the active agent mixing chamber 1 above, and offset from, the first open end portion 5 of the mixture delivery tube 4. The first open end portion 8 of the liquid delivery tube 7 forms a passage into the active agent mixing chamber 1. The second open end portion 9 of the liquid delivery tube 7 permits passage of the liquid diluent described in detail hereinabove, normally that contained in a liquid reservoir 11, into the active agent mixing chamber 1 where it is admixed with the active agent contained therein. The first open end portion 8 of the liquid delivery tube 7 is inserted into the outer wall 2 of the active agent mixing chamber 1 and through the inner wall 3 of the mixing chamber 1 above, and offset from the first open end portion 5 of the mixture delivery tube 4 into order to provide an outlet for the liquid diluent which facilitates a uniform flow thereof down, and along, the inner wall 3 of the active agent mixing chamber 1, and to prevent unintended clogging or obstruction of the first open end portion 8 of the liquid delivery tube 7 by the active agent prior to, or during, the admixing process. Preferably, the first open end portion 8 of the liquid delivery tube 7 is disposed along inner wall 3 of active agent mixing chamber 1, which disposition is as depicted in FIG. 1. The first open end portion 8 of the liquid delivery tube 7 is also proximally disposed a suitable distance below the underside of the sealing means 12 so as to prevent blockage or obstruction of the first open end portion 8 thereby, thus allowing unobstructed passage of the liquid diluent through the liquid delivery tube 7 and into the active agent mixing chamber 1. The hollow liquid delivery tube 7 may also be formed from a material or materials identical to, similar to, or different from, those disclosed hereinabove for forming the active agent mixing chamber 1 and mixture delivery tube 4. Where appropriate to facilitate initial dissolution or suspension of the active agent, or a formulation thereof, in the liquid diluent, the active agent and a small amount of the liquid diluent may be admixed in the mixing chamber 1 prior to drawing larger amounts of the liquid diluent thereinto by means of vacuum and/or suction as described hereinabove.

For convenience in mounting the apparatus on a liquid reservoir 11 prior to, or during operation, the apparatus may, if desired, further comprise mounting means 10, preferably disposed on the outer wall 2 of the active agent mixing chamber 1. The mounting means 10 may comprise any conventional arrangement known to one of ordinary skill in the art, or apparent in light of the instant disclosure, for mounting a medicament dispensing apparatus on a liquid reservoir 11, including, for example, an elongate hook or lip, a ridge or groove, or any similar, or different, means. The material comprising the mounting means 10 may comprise the same, or different, material or materials used to form the active agent mixing chamber 1. The liquid reservoir 11 may comprise any conventional device or apparatus designed to retain a liquid diluent including, for example, a drinking cup or glass, a bowl or mug, and the like.

The apparatus thus described may be conveniently operated in the following, exemplary manner. The apparatus is first charged with an active agent by physically pouring, adding, or otherwise transferring the active agent into the mixing chamber 1. The mixing chamber 1 is then sealed with sealing means 12. The charged apparatus is then most conveniently placed on a liquid reservoir 11 and secured thereon such that the second open end portion 9 of the liquid delivery tube is maintained below the level of the liquid diluent contained in the liquid reservoir 11. A vacuum is then imparted to the mixing chamber 1, thereby drawing a liquid diluent thereinto, preferably by mouth suction imparted through the mixture delivery tube 4, thereby admixing the active agent with the liquid diluent. Although the mixing dynamics resulting from the process of actively combining the liquid diluent and the active agent, or a formulation thereof, inside the mixing chamber 1 is typically sufficient to create a solution or suspension of desired and/or appropriate consistency for delivery through the mixture delivery tube 4, such dynamics may, if desired, be augmented by physical manipulation, i.e. shaking, agitating, etc., the apparatus immediately following, or during, the process of dilution. Once the liquid diluent and the active agent, or a formulation thereof, have been admixed to a desired consistency inside the mixing chamber 1, negative pressure, preferably by mouth suction, is maintained therein by the user thereof, thereby drawing the solution or suspension formed in the mixing chamber 1 through the mixture delivery tube 4 and into the oral cavity of the user. Any small amount of residual active agent/liquid diluent admixture remaining in the mixing chamber 1 following essentially complete dispensation may be finally dispensed into the oral cavity of the user by inclining the apparatus at an angle sufficient to permit flow of the residual amount of admixture into the mixture delivery tube 4 and into the oral cavity of the user.

What is claimed is:

1. An apparatus comprising:

(i) a sealable, active agent mixing chamber comprising outer and inner walls, said inner wall defining a compartment for containing and admixing an active agent, or a pharmaceutical formulation thereof, with a liquid diluent to form a solution or suspension;

(ii) a hollow mixture delivery tube comprising first and second open end portions; and (iii) at least one hollow liquid delivery tube comprising first and second open end portions; and (iv) sealing means for removably sealing said active agent mixing chamber;

wherein:

said first open end portion of said hollow mixture delivery tube is inserted into said outer wall of said active agent mixing chamber and through said inner wall of said mixing chamber, said first open end portion forming a passage thereinto;

and said first open end portion of said hollow liquid delivery tube is inserted into said outer wall of said active agent mixing chamber and through said inner wall of said mixing chamber above, and offset from, said first open end portion of said mixture delivery tube, said first open end portion also forming an opening into said mixing chamber, such that upon charging said mixing chamber with an active agent or a pharmaceutical formulation thereof, sealing said mixing chamber with said sealing means, placing said second open end portion of said liquid delivery tube into a liquid reservoir, and imparting negative pressure on said second open end portion of said mixture delivery tube, liquid is drawn through said liquid delivery tube into said mixing chamber thereby admixing said active agent with said liquid diluent to form a solution or suspension, and said solution or suspension thus formed is drawn into said first end portion, and out through said second open end portion, of said mixture delivery tube.

2. An apparatus according to claim 1 wherein said first open end portion of said mixture delivery tube is inserted into said outer wall of said mixing chamber at an angle tangential to said outer wall of said active agent mixing chamber.

3. An apparatus according to claim 1 wherein said first open end portion of said liquid delivery tube is inserted along said inner wall of active agent mixing chamber.

4. An apparatus according to claim 1 further comprising mounting means disposed thereon.

5. An apparatus according to claim 4 wherein said mounting means is disposed on said outer wall of said active agent mixing chamber.

* * * * *